US009480107B2

(12) United States Patent
Oh et al.

(10) Patent No.: US 9,480,107 B2
(45) Date of Patent: Oct. 25, 2016

(54) ELECTRONIC INDUCTION HEATING COOKER AND DRIVING METHOD THEREOF

(71) Applicant: LG ELECTRONICS INC., Seoul (KR)

(72) Inventors: Dooyong Oh, Seoul (KR); Heesuk Roh, Seoul (KR); Byeongwook Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 426 days.

(21) Appl. No.: 14/010,581

(22) Filed: Aug. 27, 2013

(65) Prior Publication Data

US 2014/0144902 A1 May 29, 2014

(30) Foreign Application Priority Data

Nov. 26, 2012 (KR) ..... 10-2012-0134416

(51) Int. Cl.
*H05B 6/06* (2006.01)
*H05B 6/04* (2006.01)

(52) U.S. Cl.
CPC ..... *H05B 6/065* (2013.01)

(58) Field of Classification Search
CPC .. H05B 6/065; H05B 6/062; H05B 2213/06; H05B 6/12; H05B 6/1218; H05B 6/1263
USPC ..... 219/620, 624, 632, 660, 661, 662, 664, 219/665; 327/427
See application file for complete search history.

(56) References Cited

U.S. PATENT DOCUMENTS

2011/0074489 A1* 3/2011 Viitanen ..... H02M 1/08 327/427
2012/0152935 A1* 6/2012 Kitaizumi ..... H05B 6/065 219/661

* cited by examiner

*Primary Examiner* — Quang Van
(74) *Attorney, Agent, or Firm* — KED & Associates, LLP

(57) ABSTRACT

An induction heating cooker is provided. The induction heating cooker may include a rectifier to rectify an input voltage into a direct current (DC) voltage and output the DC voltage, an inverter to generate an alternating current (AC) voltage by switching the DC voltage, a first heater driven by the AC voltage so as to heat a first cooking container, a second heater connected in parallel to the first heater, and driven by the AC voltage so as to heat a second cooking container, and a switching controller configured to output a switching signal to the inverter for controlling the first and second heaters in accordance with a selected operation mode. The selected operation mode may be a first operation mode for driving only the first heater, a second operation mode for driving only the second heater, or a third operation mode for driving both the first and second heaters at the same time.

11 Claims, 13 Drawing Sheets

ELECTRONIC INDUCTION HEATING COOKER AND DRIVING METHOD THEREOF

CROSS-REFERENCE TO RELATED APPLICATION(S)

This application claims priority under 35 U.S.C. §119 to Korean Application No. 10-2012-0134416 filed on Nov. 26, 2012, whose entire disclosure is hereby incorporated by reference.

BACKGROUND

1. Field

Embodiments relate to an induction heating cooker, and to driving method of such an induction heating cooker.

2. Background

Induction heating cookers are electric cooking devices that apply a high-frequency current to working coils or heating coils so as to generate lines of induction and to heat a cooking container by means of an eddy current generated by the lines of induction. More specifically, in response to a current applied to a heating coil of an induction heating cooker, a cooking container, which is made of a magnetic material, generates heat by means of induction heating and is then heated so as to perform a cooking function.

An inverter switches a voltage applied to the heating coil so that a high-frequency current may flow into the heating coil. The inverter may generate a high-frequency magnetic field in the heating coil by driving a switching device, which includes an insulated gate bipolar transistor (IGBT), so as to flow a high-frequency current into the heating coil. In a case in which two heating coils are provided in an induction heating cooker, two inverters drive the two heating coils at the same time. If only one inverter is provided even though there are two heating coils in the induction heating cooker, separate switches may be provided for the two heating coils so that the two heating coils may be selectively driven.

BRIEF DESCRIPTION OF THE DRAWINGS

The embodiments will be described in detail with reference to the following drawings in which like reference numerals refer to like elements wherein.

DETAILED DESCRIPTION

Figure 1:
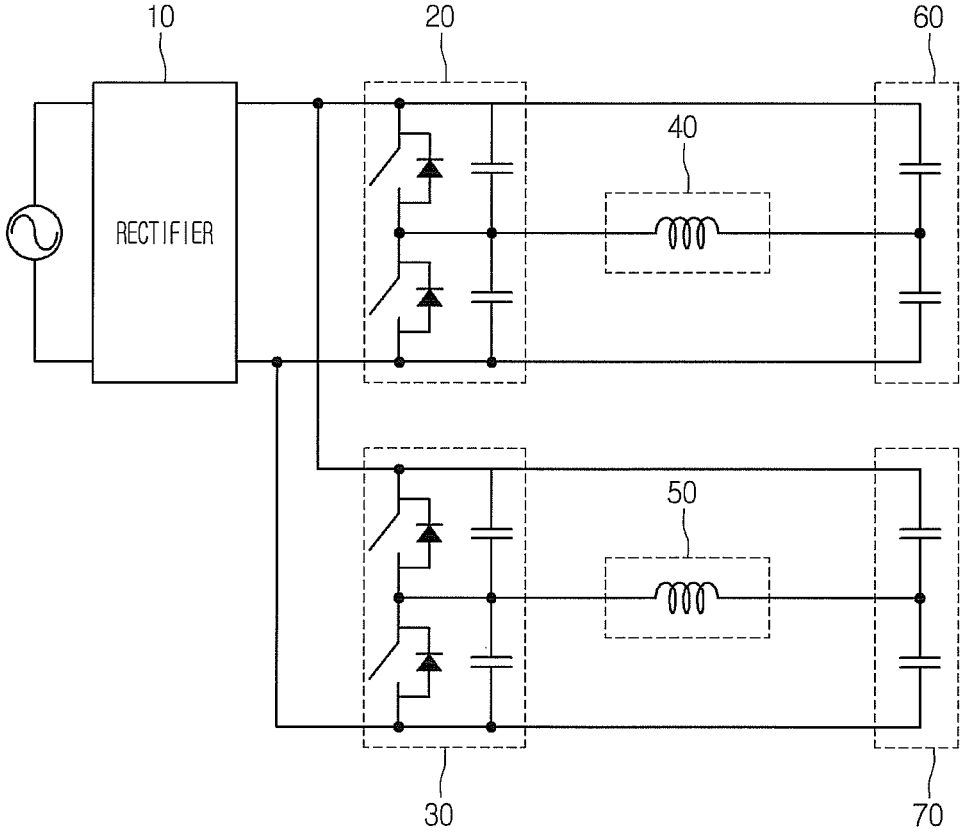
FIGS. 1 and 2 are circuit diagrams of exemplary induction heating cookers.

The following description exemplifies various principles of embodiments as broadly described herein. Even if not specifically described or illustrated herein, one of ordinary skill in the art may embody the various principles within the concept and scope of the disclosure. The conditional terms and embodiments presented herein are intended only to make understood various concepts, which are not limited to the embodiments and conditions specifically mentioned in the specification.

The detailed description of the principles, viewpoints and particular embodiments may be understood to include structural and functional equivalents to them. The equivalents include not only the currently known equivalents but also those to be developed, that is, devices that may perform the same function, regardless of their structures.

In the claims of the present specification, an element expressed as a means for performing a function described in the detailed description is intended to include all methods for performing the function including all formats of software, such as a combination of circuits that performs the function, firmware/microcode, and the like. To perform the intended function, the element is cooperated with a proper circuit for performing the software. Embodiments as defined by claims may include diverse means for performing particular functions, and the means may be connected with each other in a method indicated in the claims. Therefore, any means that may provide the function may be understood to be an equivalent.

Other objects and aspects of various embodiments will become apparent from the following description of the embodiments with reference to the accompanying drawings. The same reference numeral will be applied to the same element wherever possible, although the element appears in different drawings. In addition, repetitive detailed description is omitted.

In this disclosure, the terms "module" and "unit" may be used interchangeably.

Figure 2:
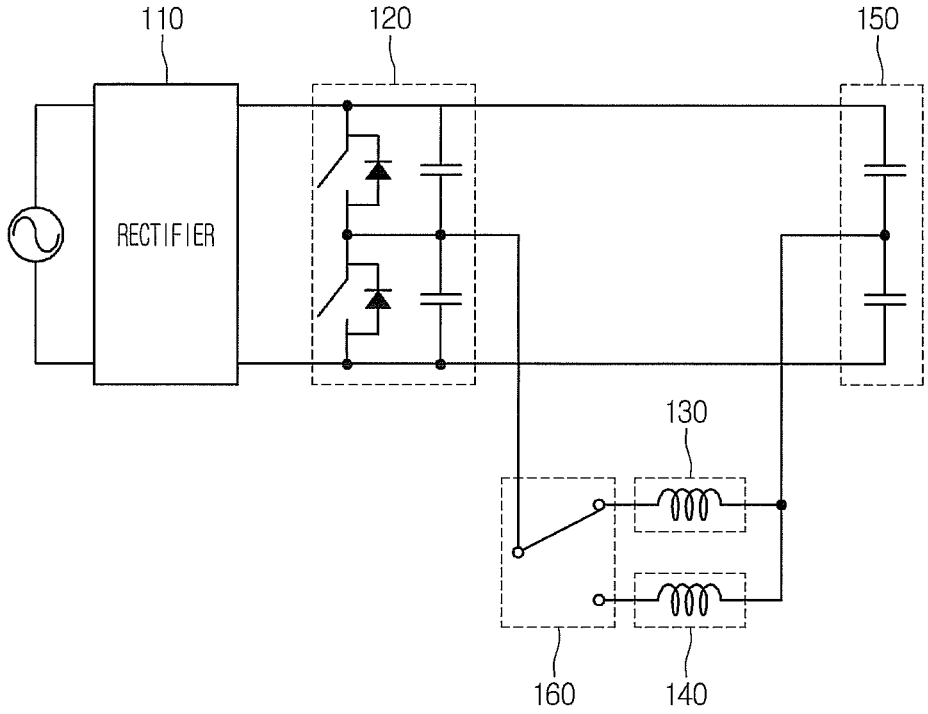

FIGS. 1 and 2 are circuit diagrams of exemplary induction heating cookers. More specifically, FIG. 1 illustrates an exemplary induction heating cooker including two inverters and two heating coils, and FIG. 2 illustrates an exemplary induction heating cooker including one inverter and two heating coils.

The induction heating cooker as shown in FIG. 1 includes a rectifier 10, a first inverter 20, a second inverter 30, a first heating coil 40, a second heating coil 50, a first resonant capacitor 60, and a second resonant capacitor 70. The first and second inverters 20 and 30 are connected in series to a first switching device that switches input power. The first and second heating coils 40 and 50 are driven by an output voltage of the first switching device. The first and second inverters 20 and 30 are also connected to a connection node of a second switching device to which the first and second heating coils 40 and 50 are connected in series. The first and second heating coils 40 and 50 are also connected to the resonant capacitors 60 and 70.

The first and second switching devices are driven by a driver. More specifically, the first and second switching devices apply a high-frequency voltage to the first and second heating coils 40 and 50 while being alternately driven in accordance with switching time information output by the driver. Since the on/off time of the first and second switching devices is controlled so as to be gradually compensated for by the driver, the voltage applied to the first and second heating coils 40 and 50 changes from a low level to a high level. However, the induction heating cooker shown in FIG. 1 uses two inverters 20, 30 to drive the two heating coils 40, 50, which increases product size and manufacturing cost.

The exemplary induction heating cooker shown in FIG. 2 includes a rectifier 110, an inverter 120, a first heating coil 130, a second heating coil 140, a resonant capacitor 150, and a switch 160 to selectively drive one of the first or second heating coils 130 and 140 using a single inverter 120. Which of the first or second heating coils 130 and 140 is driven is determined by the switch 160. However, in the induction heating cooker shown in FIG. 2, selection of one of the first or second heating coils 130 and 140 by the switch 160 may generate noise. In addition, since only one of the first or second heating coils 130 and 140 is driven, or the first and second heating coils 130 and 140 are alternatively driven, the induction heating cooker of FIG. 2 may have a lower output.

Figure 3:
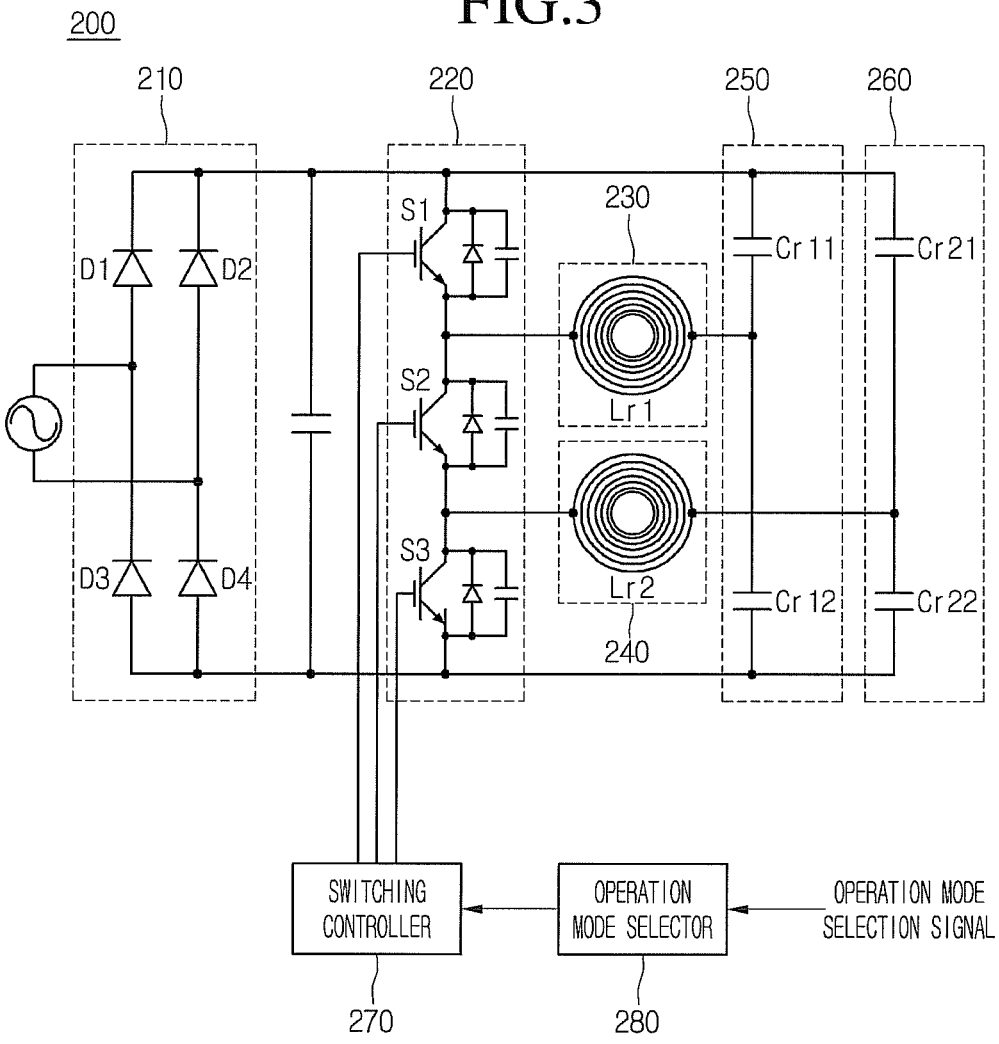
FIG. 3 is a circuit diagram of an induction heating cooker according to an embodiment as broadly described herein.

FIG. 3 is a circuit diagram of an induction heating cooker according to an embodiment as broadly described herein.

Referring to FIG. 3, an induction heating cooker 200 may include a rectifying device 210 which receives a common alternating current (AC) voltage from an external source and rectifies the AC voltage into a direct current (DC) voltage, an inverter 220 connected in series between a positive power source terminal and a negative power source terminal to provide a resonant voltage by being switched in accordance with a control signal, a first heating coil 230 (Lr1) connected to the output terminal of the inverter 220, a second heating coil 240 (Lr2) connected to the output terminal of the inverter 220 and also connected in parallel to the first heating coil 230, a first resonant capacitor unit 250 including a plurality of first resonant capacitors Cr11 and Cr12 connected in parallel to each other, a second resonant capacitor unit 260 including a plurality of second resonant capacitors Cr21 and Cr22 connected in parallel to each other, a switching controller 270 which applies different switching signals for different operation modes to each switch included in the inverter 220, and an operation mode selector 280 which receives an operation mode selection signal from an external source and applies the received operation mode selection signal to the switching controller 270. In certain embodiments, the induction heating cooker 200 may also include a smoothing capacitor.

The rectifying device 210 may include a first rectifier D1, a second rectifier D2, a third rectifier D3, and a fourth rectifier D4. The first and third rectifiers D1 and D3 may be connected in series, and the second and fourth rectifiers D2 and D4 may be connected in series.

The inverter 220 may include a plurality of switches, for example, first, second and third switches S1, S2 and S3.

A first end of the first switch S1 may be connected to a positive power source terminal, and a second end of the first switch S1 may be connected to a first end of the second switch S2. The first end of the second switch S2 may be connected to the second end of the first switch S1, and a second end of the second switch S2 may be connected to a first end of the third switch S3. The first end of the third switch S3 may be connected to the second end of the second switch S2, and a second end of the third switch S3 may be connected to a negative power source terminal.

A first end of the first heating coil 230 may be connected to the connection node between the second end of the first switch S1 and the first end of the second switch S2, and a second end of the first heating coil 230 may be connected between the first resonant capacitors Cr11 and Cr12. A first end of the second heating coil 240 may be connected to the connection node between the second end of the second switch S2 and the first end of the third switch S3, and a second end of the second heating coil 240 may be connected between the second resonant capacitors Cr21 and Cr22.

The first heating coil 230 and the first resonant capacitor unit 250 may form a first resonant circuit and may operate as a first burner. The second heating coil 240 and the second resonant capacitor unit 260 may form a second resonant circuit and may operate as a second burner.

An anti-parallel diode may be connected to each of the first, second and third switches S1, S2 and S3 of the inverter 220. To minimize switching loss at each of the first, second and third switches S1, S2 and S3 of the inverter 220, an auxiliary resonant capacitor may be connected in parallel to the anti-parallel diode.

The switching controller 270 may be connected to the gates of the first, second and third switches S1, S2 and S3, and may output a gate signal for controlling the switching state of the first, second and third switches S1, S2 and S3. The gate signal may be a signal that determines the switching state of the first, second and third switches S1, S2 and S3.

The operation mode selector 280 may receive a selection of an operation mode for the electronic induction heating cooker 200 from an external source. The operation mode for the electronic induction heating cooker 200 may include first, second, third and fourth operation modes.

In the first operation mode, an eddy current is induced only in a cooking container on the first heating coil 230, to drive only the first heating coil 230. In the second operation mode, an eddy current is induced only in a cooking container on the second heating coil 240, to drive only the second heating coil 240. In the third operation mode, an eddy current is induced in cooking containers on both the first and second heating coils 230 and 240, to drive both the first and second heating coils 230 and 240.

In the fourth operation mode, an eddy current is induced in the cooking container on the first heating coil 230 for a first period of time, and is induced in the cooking container on the second heating coil 240 for a second period of time, to alternately drive the first and second coils 230 and 240.

In short, the switching controller 270 may provide a switching signal to each of the first, second and third switches S1, S2 and S3 according to an operation mode selected by the operation mode selector 280. More specifically, in response to the first operation mode being selected, the switching controller 270 outputs a switching signal to the first, second and third switches 51, S2 and S3 such that only the first resonant circuit may be selectively driven. In response to the second operation mode being selected, the switching controller 270 outputs a switching signal to the first, second and third switches S1, S2 and S3 such that only the second resonant circuit may be selectively driven. In response to the third operation mode being selected, the switching controller 270 outputs a switching signal to the first, second and third switches S1, S2 and S3 such that the first and second resonant circuits may both be driven at the same time. In response to the fourth operation mode being selected, the switching controller 270 outputs a switching signal to the first, second and third switches S1, S2 and S3 such that the first and second resonant circuits may be alternately driven.

A switching signal for an operation mode selected and the operation of the electronic induction heating cooker 200 in accordance with the switching signal will hereinafter be described with respect to FIGS. 4-6.

Figure 4:
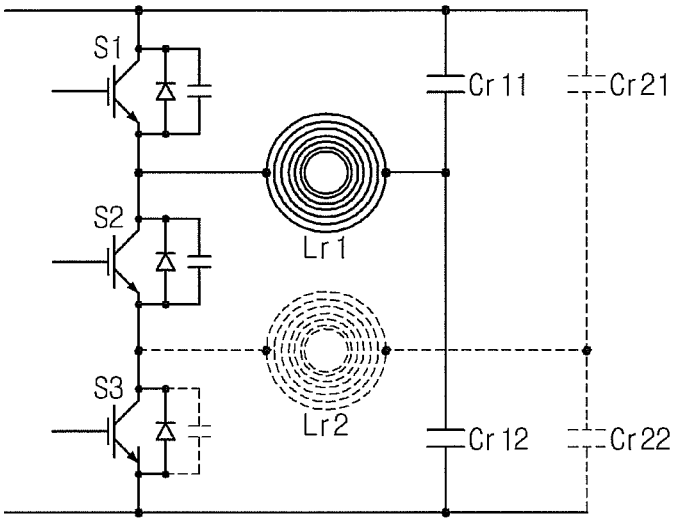
FIG. 4 is a circuit diagram of the induction heating cooker shown in FIG. 3 in a first operation mode.
Figure 5:
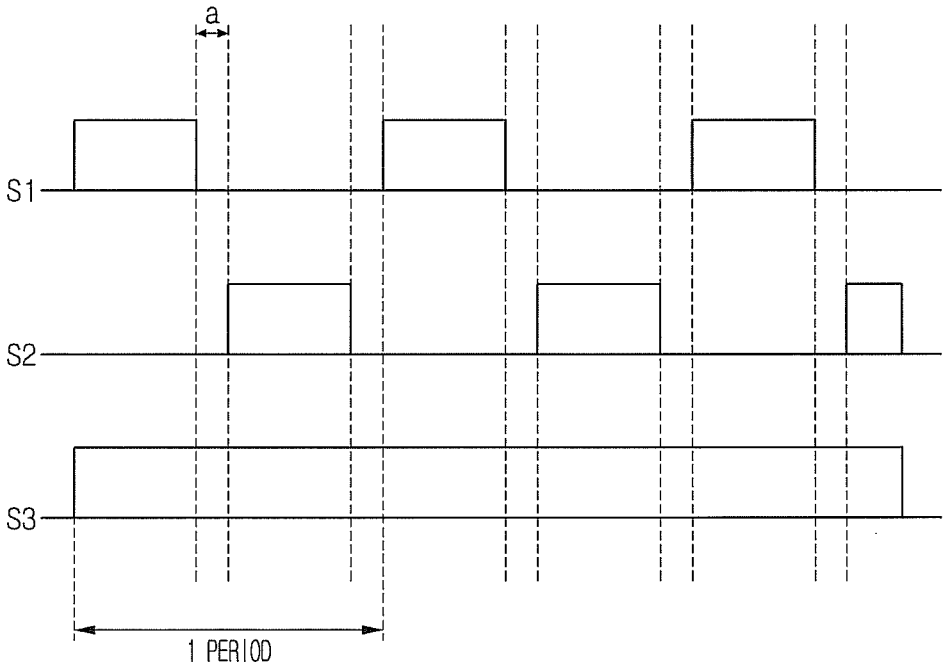
FIG. 5 illustrates a first switching signal according to an embodiment.
Figure 6:
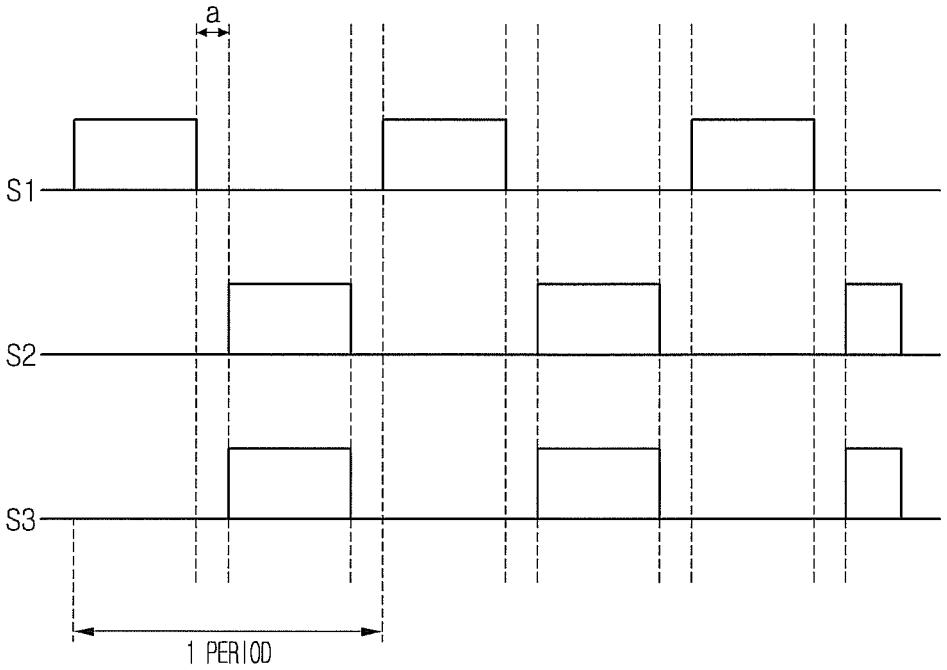
FIG. 6 illustrates a first switching signal according to another embodiment.

Referring to FIGS. 4 to 6, in response to the first operation mode being selected, the switching controller 270 outputs a first switching signal to the first, second and third switches S1, S2, and S3. More specifically, the switching controller 270 may control the third switch S3 to continue to be closed, may control the second switch S2 to be open, and may control the first switch S1 to be closed. In such a case, in which the first and third switches S1 and S3 are closed and the second switch S2 is open, an input voltage Vd is applied to the first heating coil 230 and the first resonant capacitors Cr11 and Cr12. As a result, the first resonant capacitors Cr11 and Cr12 begin to resonate, and the current of the first heating coil 230 increases.

During a first half of a resonant period, the first and third switches S1 and S3 may continue to be closed and the second switch S2 may continue to be open.

The switching controller 270 opens the first switch S1 from a "zero voltage" condition after a lapse of less than half of the resonant period. Then, if the first switch S1 is opened by the switching controller 270, the auxiliary resonant capacitors respectively connected to the first and second switches S1 and S2 perform auxiliary resonance. As a result, the voltage of the auxiliary resonant capacitor connected to the second switch S2 drops from the input voltage Vd to zero, and the voltage of the auxiliary resonant capacitor connected to the first switch 51 increases from zero to the input voltage Vd.

Then, a current is applied to the anti-parallel diode connected to the second switch S2, and thus, a zero voltage is applied to the first heating coil 230. Accordingly, due to a continued resonance, the current of the first heating coil 230 drops to zero. In response to the current of the first heating coil 230 reaching zero, the switching controller 270 controls the second switch S2 to be closed in a "zero voltage/zero current" condition. In this manner, switching loss at the first, second and third switches S1, S2 and S3 may be minimized.

In response to the second switch S2 being closed, the input voltage Vd is inversely applied to the first heating coil 230. As a result, due to resonance, the current of the first heating coil 230 increases. That is, during the rest of the resonant period, the second and third switches S2 and S3 are closed, and the first switch S1 is open.

The switching controller 270 releases the second switch S2 from the "zero voltage" condition after a lapse of less than half of the resonant period. As a result, the auxiliary resonant capacitors respectively connected to the first, second, and third switches S1, S2, and S3, the first heating coil 230 and the first resonant capacitors Cr11 and Cr12 perform auxiliary resonance. Accordingly, the voltage of the auxiliary resonant capacitor connected to the first switch drops from the input voltage Vd to zero, and the voltage of the auxiliary resonant capacitor connected to the second switch S2 increases from zero to the input voltage Vd.

Then, a current is applied to the anti-parallel diode connected to the first switch S1, and thus, a zero voltage is applied to the first heating coil 230. Accordingly, due to a continued resonance, the current of the first heating coil 230 drops to zero.

In response to the current of the first heating coil 230 reaching zero, the switching controller 270 controls the first switch S1 to be closed in the "zero voltage/zero current" condition. In this manner, switching loss at the first, second and third switches S1, S2 and S3 may be minimized.

Upon completion of the above-mentioned switching of the first, second and third switches S1, S2 and S3, the operation of the electronic induction heating cooker 200 for a single resonant period is complete, and the electronic induction heating cooker 200 may continue to perform the corresponding operation for subsequent resonant periods.

The first switching signal may be as shown by Table 1 below.

TABLE 1

| | First Half of Resonant period | Second Half of Resonant period |
|---|---|---|
| First Switch | Closed | Open |
| Second Switch | Open | Closed |
| Third Switch | Closed | Closed |

The switching controller 270 controls the third switch S3 to continue to be open while controlling the first and second switches S1 and S2 to be alternately open or closed every half a resonant period.

In response to the first switching signal being applied, only the first heating coil 230 and the first resonant capacitors Cr11 and Cr12 may be driven, as illustrated in FIG. 4.

The third switch S3 may not necessarily be closed all the time. That is, the switching state of the third switch S3, like that of the first and second switches S1 and S2, may vary. More specifically, the switching controller 270 may turn the third switch S3 on or off so that the opening or closing of the third switch S3 may be synchronized with the opening or closing of the second switch S2, as shown in Table 2 below.

TABLE 2

| | First Half of Resonant period | Second Half of Resonant period |
|---|---|---|
| First Switch | Closed | Open |
| Second Switch | Open | Closed |
| Third Switch | Open | Closed |

Referring to Table 2, the third switch S3 is open for half a resonant period and closed for the rest of the resonant period. Even in this example, only the first heating coil 230 and the first resonant capacitors Cr11 and Cr12 are driven.

Referring to FIGS. 5 and 6, reference character 'a' indicates a dead time. Due to the dead time a, it is possible to minimize switching loss.

The second operation mode will hereinafter be described.

Figure 7:
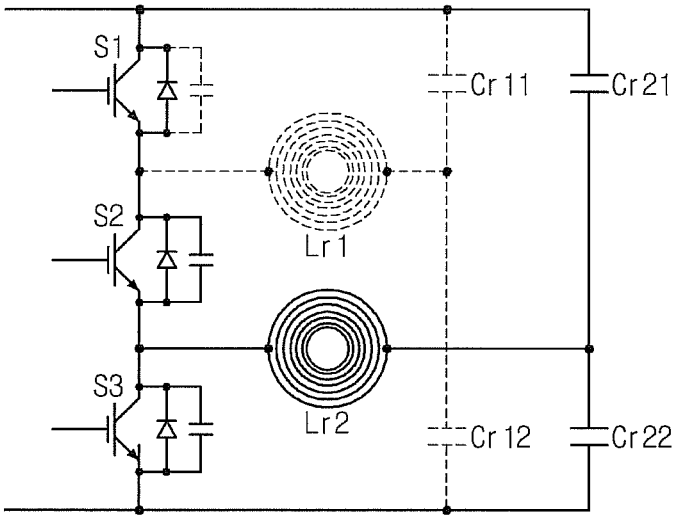
FIG. 7 is a circuit diagram of the induction heating cooker shown in FIG. 3 in a second operation mode.
Figure 8:
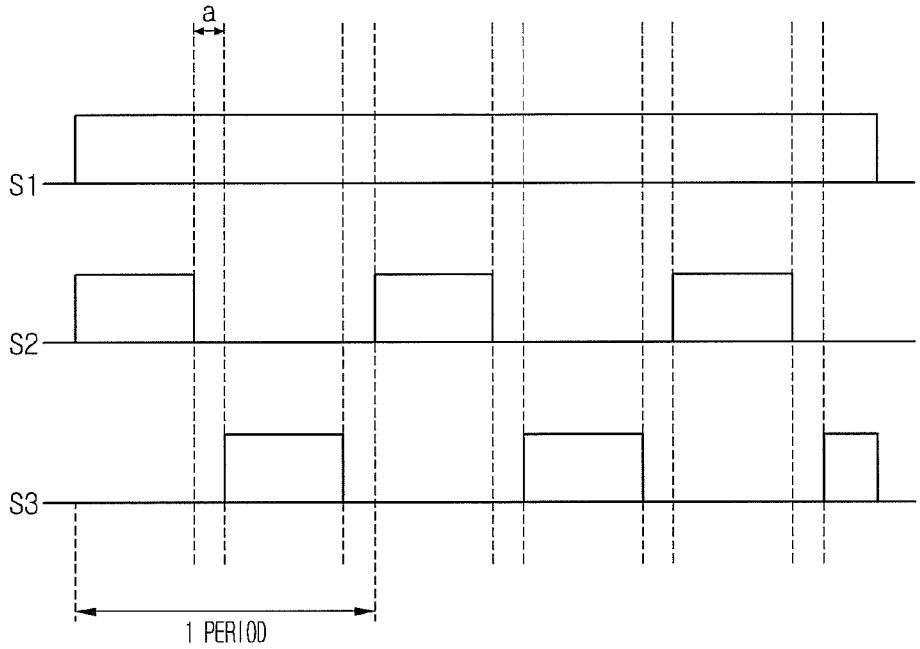
FIG. 8 illustrates a second switching signal according to an embodiment.
Figure 9:
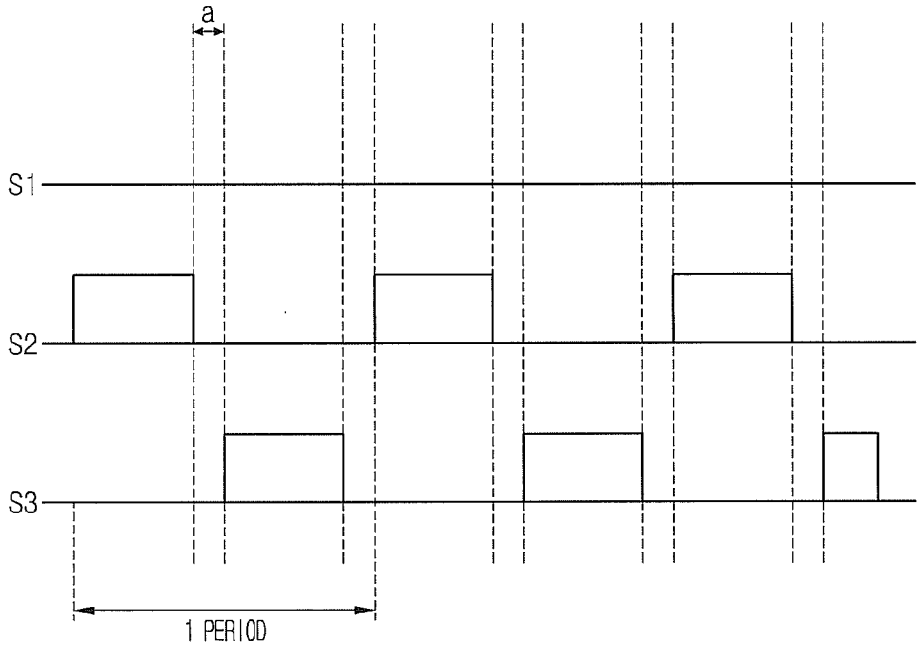
FIG. 9 illustrates a second switching signal according to another embodiment.

FIG. 7 is a circuit diagram of the electronic induction heating cooker 200 in the second operation mode, FIG. 8 is a diagram of a second switching signal according to an embodiment, and FIG. 9 is a diagram of a second switching signal according to another embodiment.

Referring to FIGS. 7 to 9, in response to the second operation mode being selected, the switching controller 270 outputs a second switching signal to the first, second and third switches 51, S2 and S3. More specifically, the switching controller 270 may control the first switch S1 to continue to be closed, and may control the second and third switches S2 and S3 to be alternately open or closed.

That is, during a first half of a resonant period, the switching controller 270 may control the first and second switches S1 and S2 to be closed and control the third switch S3 to be open. During a second half of the resonant period, the switching controller 270 may control the first and third switches S1 and S3 to be closed and may control the second switch S2 to be open. The first, second, and third switches S1, S2, and S3 may be switched on or off during the second operation mode, as shown in Table 3 below.

TABLE 3

| | First Half of Resonant period | Second Half of Resonant period |
|---|---|---|
| First Switch | Closed | Closed |
| Second Switch | Closed | Open |
| Third Switch | Open | Closed |

Alternatively, the switching controller 270 may control the first switch S1 to continue to be open while controlling the second and third switches S2 and S3 to be alternately open or closed, as shown in Table 4 below.

TABLE 4

| | First Half of Resonant period | Second Half of Resonant period |
|---|---|---|
| First Switch | Open | Open |
| Second Switch | Closed | Open |
| Third Switch | Open | Closed |

Referring to Tables 3 and 4, the switching controller 270 may control the first, second and third switches S1, S2 and S3 in response to the second switching signal such that only the second heating coil 240 and the second resonant capacitors Cr21 and Cr22 are driven.

Figure 10:
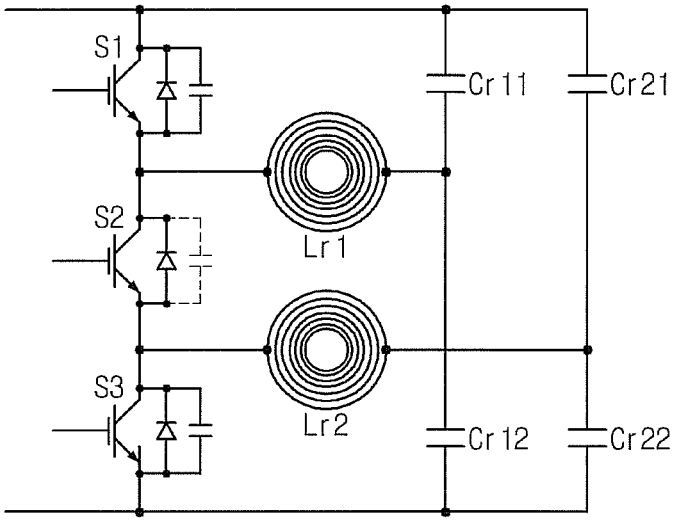
FIG. 10 is a circuit diagram of the induction heating cooker shown in FIG. 3 in a third operation mode.
Figure 11:
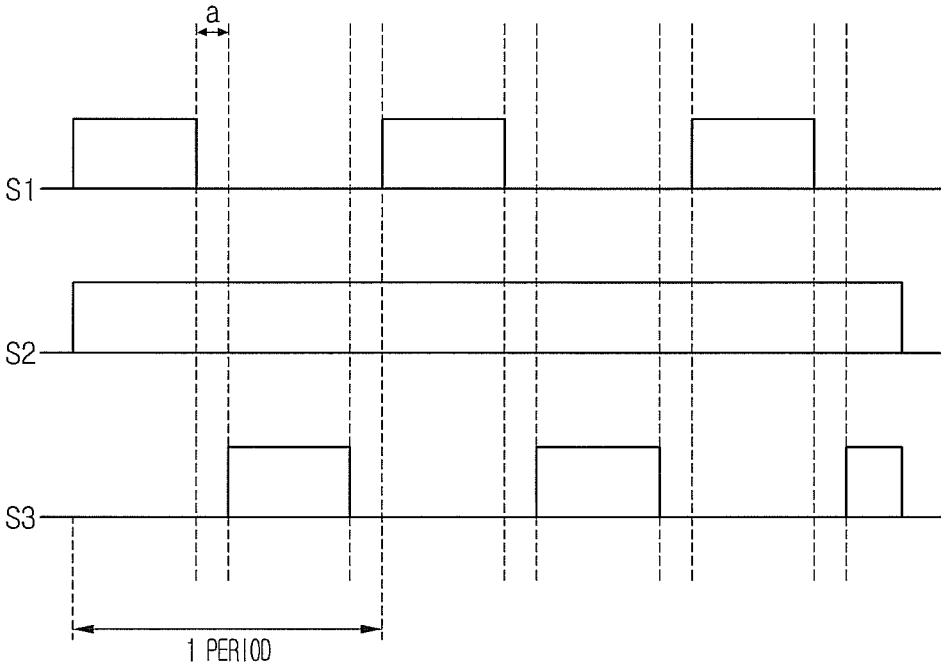
FIG. 11 illustrates a third switching signal according to an embodiment.

FIG. 10 is a circuit diagram of the induction heating cooker 200 in the third operation mode, and FIG. 11 is a diagram illustrating a third switching signal according to an embodiment.

Referring to FIGS. 10 and 11, in response to the third operation mode being selected, the switching controller 270 outputs a third switching signal to the first, second and third switches S1, S2 and S3.

More specifically, the switching controller 270 may control the second switch to continue to be closed, and may control the first and third switches S1 and S3 to be alternately open or closed. That is, during a first half of a resonant period, the switching controller 270 may control the first and second switches S1 and S2 to be closed, and may control the third switch S3 to be open. During a second half of a resonant period, the switching controller 270 may control the second and third switches S2 and S3 to be closed, and may control the first switch S1 to be open. The first, second, and third switches S1, S2, and S3 may be switched on or off during the third operation mode, as shown in Table 5 below.

TABLE 5

| | First Half of Resonant period | Second Half of Resonant period |
|---|---|---|
| First Switch | Closed | Open |
| Second Switch | Closed | Closed |
| Third Switch | Open | Closed |

Referring to Table 5, the switching controller 270 controls the first, second and third switches S1, S2 and S3 in response to the third switching signal such that not only the first heating coil 230 and the first resonant capacitors Cr11 and Cr12 but also the second heating coil 240 and the second resonant capacitors Cr21 and Cr22 are driven.

Figure 12:
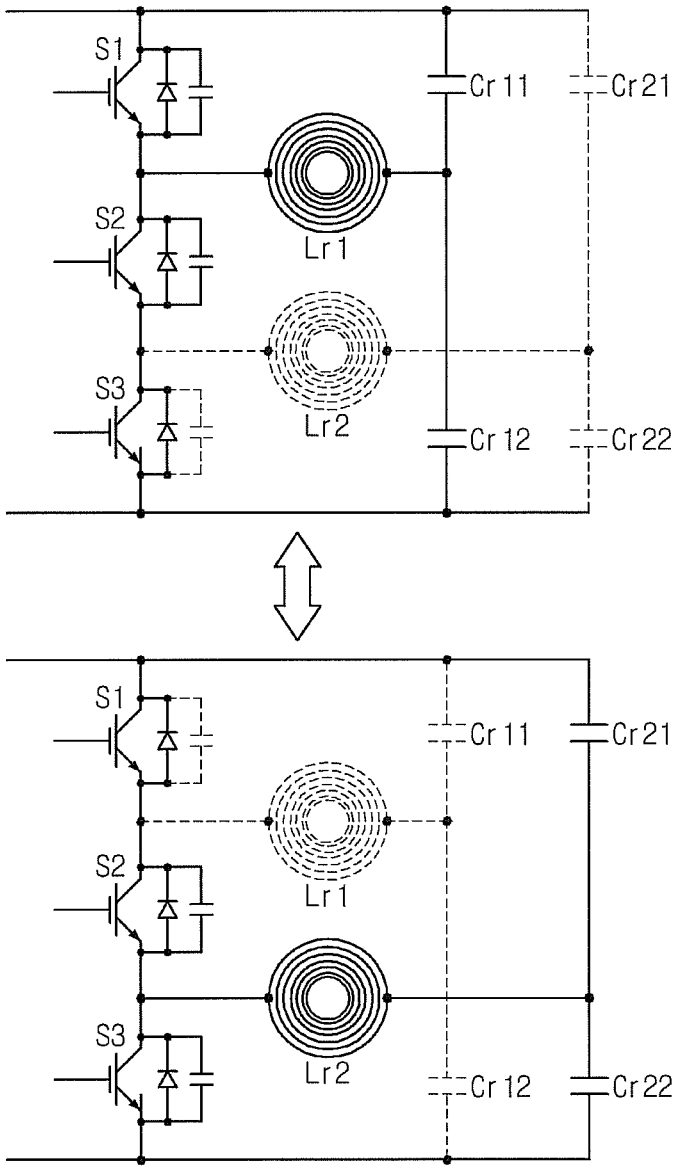
FIG. 12 is a circuit diagram of the induction heating cooker shown in FIG. 3 in a fourth operation mode.

FIG. 12 is a circuit diagram of the induction heating cooker 200 in the fourth operation mode.

Referring to FIG. 12, in response to the fourth operation mode being selected, the switching controller 270 may output the first switching signal of Table 1 or 2 during a first resonant cycle, and may output the second switching signal of Table 3 or 4 during a second resonant cycle, which follows the first resonant cycle, as shown in Table 6 below.

TABLE 6

| | First Resonant period | | Second Resonant period | |
|---|---|---|---|---|
| | First Half | Second Half | First Half | Second Half |
| First Switch | Closed | Open | Closed | Closed |
| Second Switch | Open | Closed | Closed | Open |
| Third Switch | Closed | Closed | Open | Closed |

Referring to Table 6, the switching controller 270 may output a first switching signal during the first resonant period so as to drive the first heating coil 230 and the first resonant capacitors Cr11 and Cr12, and may output a second switching signal during the second resonant period so as to drive the second heating coil 240 and the second resonant capacitors Cr21 and Cr22.

Accordingly, as illustrated in FIG. 12, the first resonant circuit including the first heating coil 230 and the first resonant capacitors Cr11 and Cr12 and the second resonant circuit including the second heating coil 240 and the second resonant capacitors Cr21 and Cr22 are alternately driven.

According to embodiments, a plurality of heating coils may be driven by using a single inverter with three switching devices. Therefore, the circuitry of an induction heating cooker may be simplified and volume and manufacturing cost of an induction heating cooker may be reduced.

According to embodiments, user satisfaction may be improved by driving a plurality of heating coils at the same time by means of a single inverter.

According to embodiments, additional switches for driving a plurality of heating coils are not needed, eliminating noise that may be generated by such switches and improving the reliability of an induction heating cooker.

Driving methods of an induction heating cooker, according to an embodiment, will hereinafter be described with respect to FIGS. 13-17.

Figure 13:
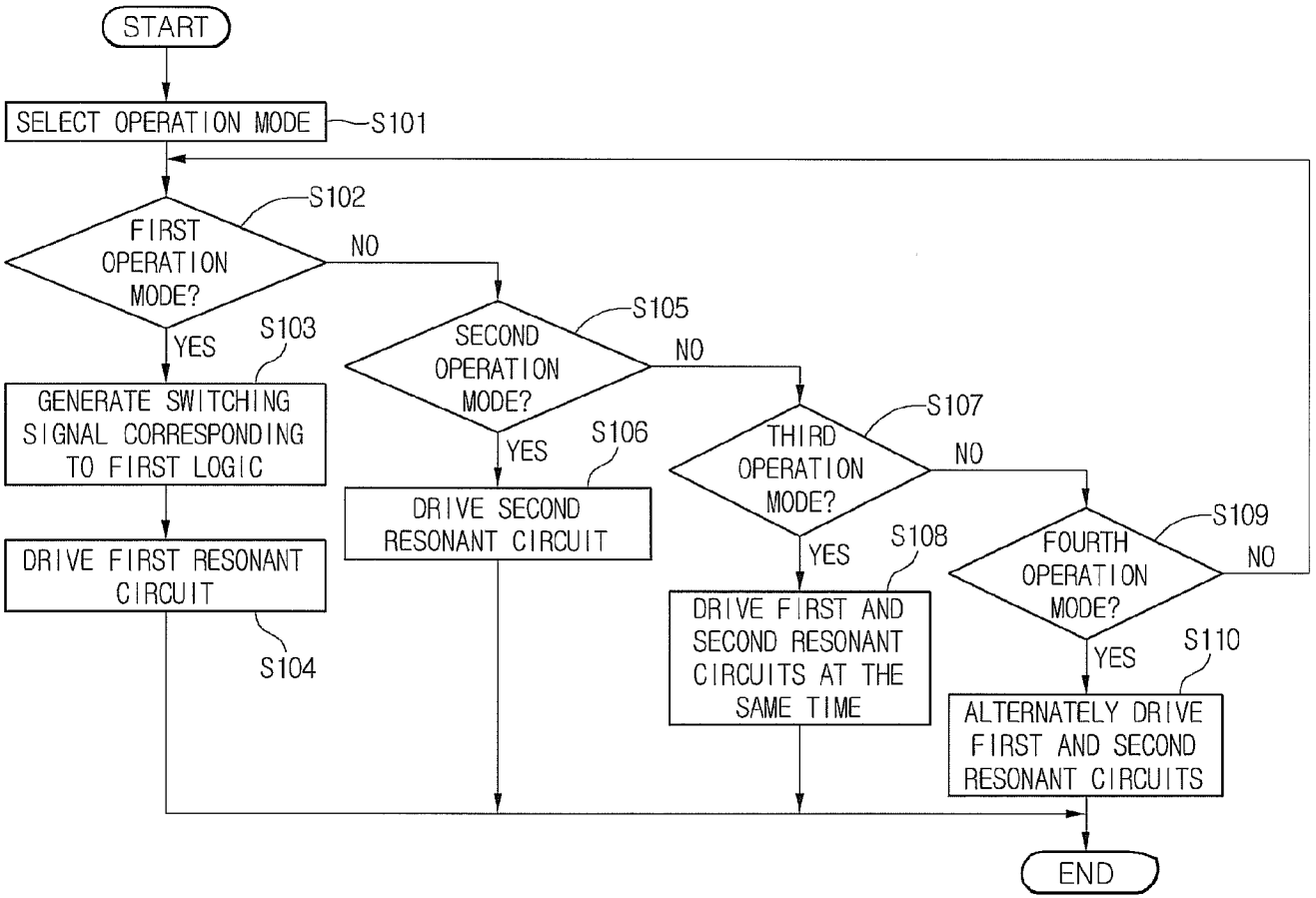
FIG. 13 is a flowchart of a driving method of an induction heating cooker, according to an embodiment as broadly described herein.

FIG. 13 is a flowchart of a driving method of an induction heating cooker, according to an embodiment as broadly described herein.

Referring to FIG. 13, the operation mode selector 280 receives an operation mode selection signal from an external source (S101). In response to the receipt of the operation mode selection signal, the operation mode selector 280 transmits information on an operation mode selected by the operation mode selection signal to the switching controller 270. The switching controller 270 determines whether the selected operation mode is a first operation mode (S102). That is, the switching controller 270 determines whether the first operation mode, which is for driving only the first heating coil 230, has been selected. In response to the first operation mode being selected (S102), the switching controller 270 generates a switching signal corresponding to first logic, i.e., a first switching signal, so as to control the first to third switches S1 to S3 included in the inverter 220 (S103). In response to the inverter 220 being driven by the first switching signal, the first resonant circuit including the first heating coil 230 and the first resonant capacitor 250 is driven (S104).

In response to the first operation mode not being selected (S102), the switching controller 270 determines whether the selected operation mode is a second operation mode (S105). That is, the switching controller 270 determines whether the second operation mode, which is for driving only the second heating coil 240, has been selected.

In a case in which the second operation mode is selected (S105), the switching controller 270 generates a switching signal corresponding to second logic, i.e., a second switching signal, so as to control the first to third switches S1 to S3 included in the inverter 220. In response to the inverter 220 being driven by the second switching signal, the second resonant circuit including the second heating coil 240 and the second resonant capacitor 260 is driven (S106).

In response to the second operation mode not being selected (S105), the switching controller 270 determines whether the selected operation mode is a third operation mode (S107). That is, the switching controller 270 determines whether the third operation mode, which is for driving a plurality of heating coils at the same time, has been selected.

In response to the third operation mode being selected (S107), the switching controller 270 generates a switching signal corresponding to third logic, i.e., a third switching signal, so as to control the first to third switches S1 to S3 included in the inverter 220. In response to the inverter 220 being driven by the third switching signal, the first resonant circuit including the first heating coil 220 and the first resonant capacitor 250 and the second resonant circuit including the second heating coil 240 and the second resonant capacitor 260 are both driven at the same time (S108).

In response to the third operation mode not being selected (S107), the switching controller 270 determines whether the selected operation mode is a fourth operation mode (S109). That is, the switching controller 270 determines whether the fourth operation mode, which is for alternately driving a plurality of heating coils, has been selected. In response to the fourth operation mode being selected (S109), the switching controller 270 generates a switching signal corresponding to fourth logic, i.e., a fourth switching signal, so as to control the first to third switches S1 to S3 included in the inverter 220. In response to the inverter 220 being driven by the fourth switching signal, the first resonant circuit including the first heating coil 220 and the first resonant capacitor 250 is driven during a first resonant period, and the second resonant circuit including the second heating coil 240 and the second resonant capacitor 260 is driven during a second resonant period (S110).

Figure 14:
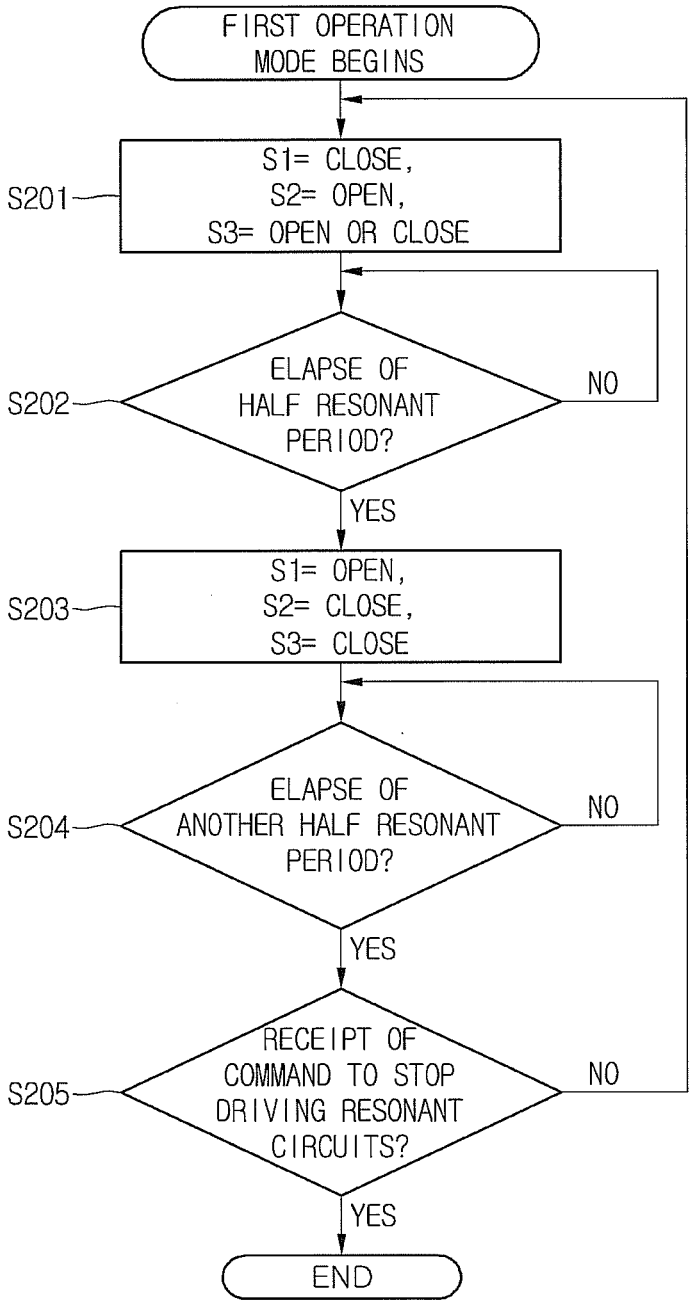
FIG. 14 is a flowchart of a first operation mode of the method shown in FIG. 13.

Referring to FIG. 14, in response to the first operation mode being selected, the switching controller 270 closes the first switch S1, opens the second switch S2 and opens or closes the third switch S3 (S201).

The switching controller 270 then determines whether half a resonant period has elapsed since performing the operation S201 (S202).

If half a resonant period has elapsed (S202) since performing the operation S201, the switching controller 270 opens the first switch S1, closes the second switch S2, and closes the third switch S3 (S203).

The switching controller 270 then determines whether half a resonant period has elapsed since performing the operation S203 (S204).

If half a resonant period has elapsed (S204), the switching controller 270 determines whether a command to stop driving resonant circuits has been received (S205).

If the command to stop driving the first and/or second resonant circuit(s) has been received (S205), the first operation mode is terminated. On the other hand, if the command to stop driving resonant circuits has not been received (S205), the switching controller 270 returns to operation S201.

Figure 15:
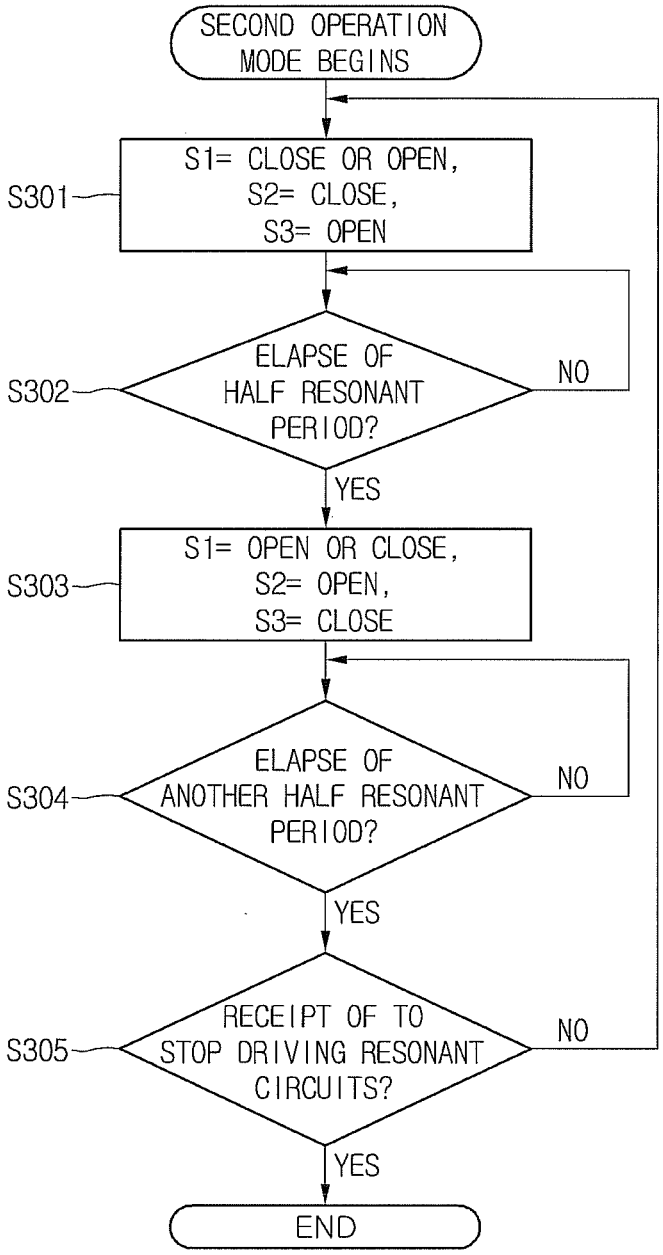
FIG. 15 is a flowchart of a second operation mode of the method shown in FIG. 13.

Referring to FIG. 15, in response to the second operation mode being selected, the switching controller 270 opens or closes the first switch S1, opens the second switch S2 and closes the third switch S3 (S301).

The switching controller 270 then determines whether half a resonant period has elapsed since performing the operation S301 (S302).

If half a resonant period has elapsed (S302), the switching controller 270 opens or closes the first switch S1, opens the second switch S2, and closes the third switch S3 (S303).

The switching controller 270 then determines whether half a resonant period has elapsed since performing the operation S303 (S304).

If half a resonant period has elapsed (S304), the switching controller 270 determines whether a command to stop driving the first and/or second resonant circuit(s) has been received (S305).

If the command to stop driving resonant circuits has been received (S305), the second operation mode is terminated. On the other hand, if the command to stop driving resonant circuits has not been received (S305), the switching controller 270 returns to operation S301.

Figure 16:
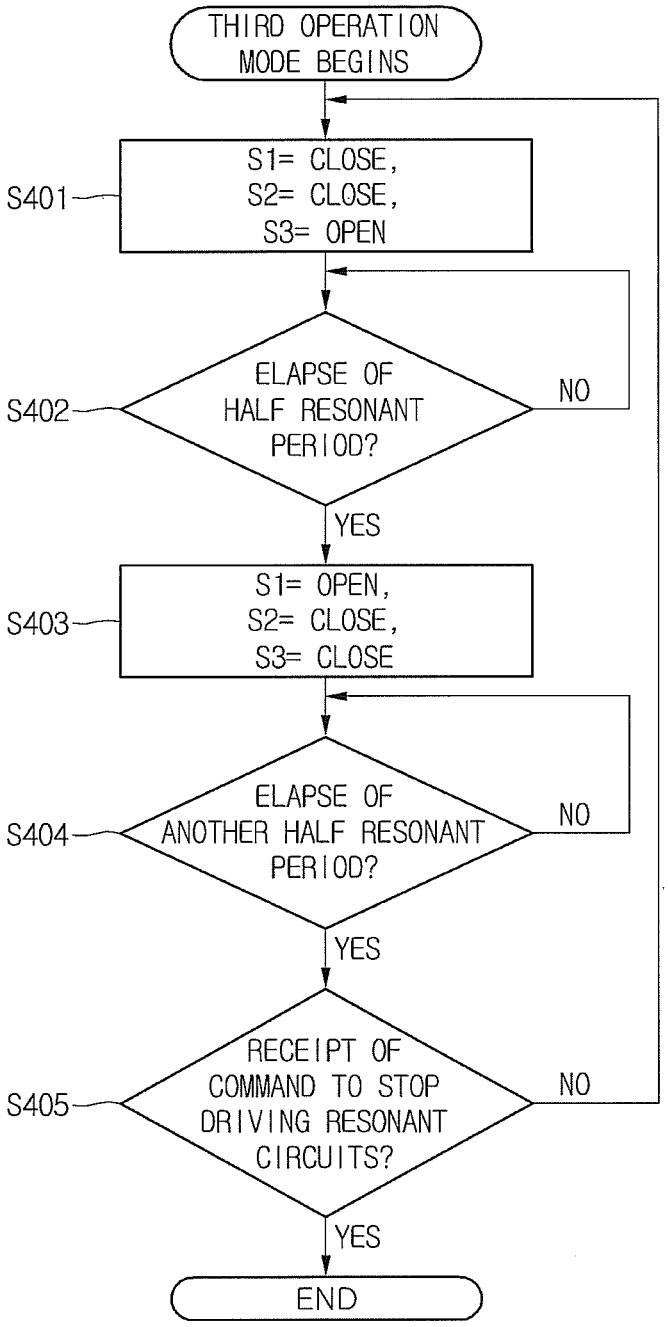
FIG. 16 is a flowchart of a third operation mode of the method shown in FIG. 13.

Referring to FIG. 16, in response to the third operation mode being selected, the switching controller 270 closes the first and second switches S1 and S2 and opens the third switch S3 (S401).

The switching controller 270 determines whether half a resonant period has elapsed since performing the operation S401 (S402).

If half a resonant period has elapsed (S402), the switching controller 270 opens the first switch S1 and closes the second and third switches S2 and S3 (S403).

The switching controller 270 determines whether half a resonant period has elapsed since performing the operation S403 (S404).

If half a resonant period being has elapsed (S404), the switching controller 270 determines whether a command to stop driving the first and/or second resonant circuit(s) has been received (S405).

If the command to stop driving resonant circuits has been received (S405), the third operation mode is terminated. On the other hand, if the command to stop driving resonant circuits has not been received (S405) to have not been received, the switching controller 270 returns to operation S401.

Figure 17:
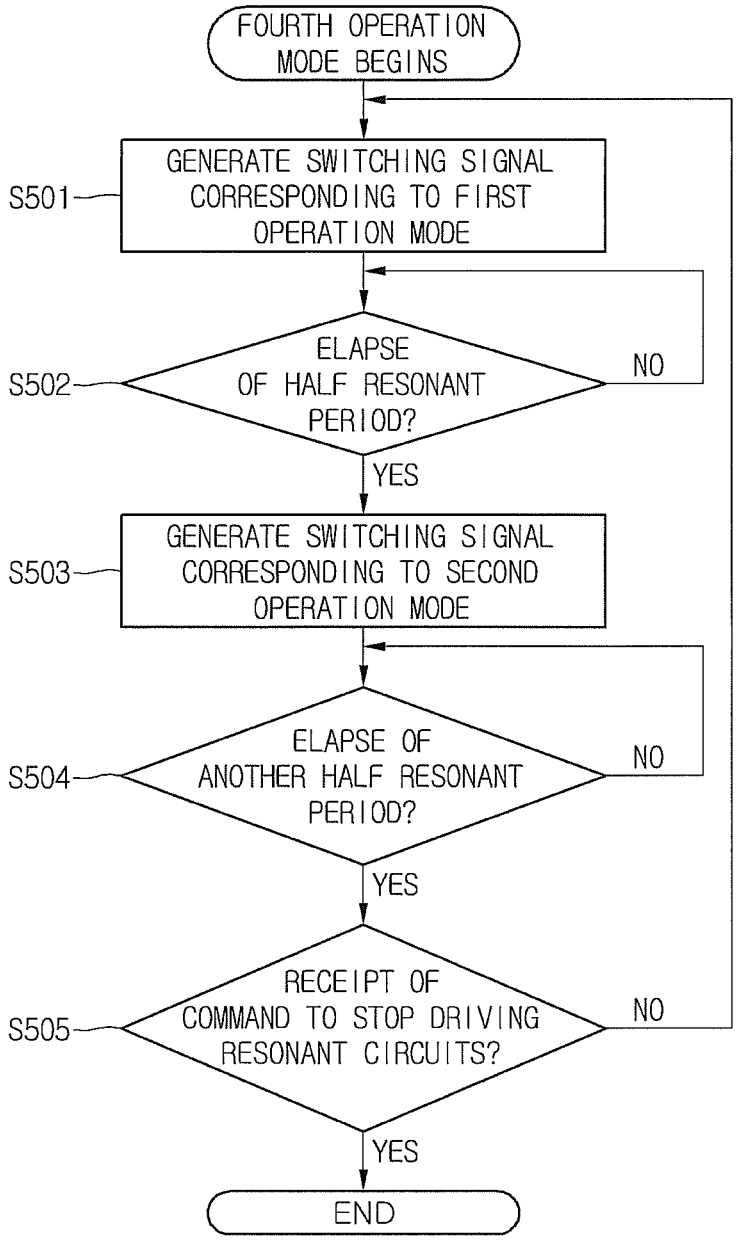
FIG. 17 is a flowchart of a fourth operation mode of the method shown in FIG. 13.

Referring to FIG. 17, in response to the fourth operation mode being selected, the switching controller 270 generates a switching signal for driving the first resonant circuit during a first resonant period (S501).

The switching controller 270 then determines whether the first resonant period has elapsed (S502).

If the first resonant period has elapsed (S502), the switching controller 270 generates a switching signal for driving the second resonant circuit during a second resonant period (S503).

The switching controller 270 then determines whether the second resonant period has elapsed (S504).

If the second resonant period has elapsed (S504), the switching controller 270 determines whether a command to stop driving the first and/or second resonant circuit(s) has been received (S505).

If the command to stop driving resonant circuits has been received (S505), the fourth operation mode is terminated. On the other hand, if the command to stop driving resonant circuits has not been received (S505), the switching controller 270 returns to operation S501.

Embodiments provide an electronic induction heating cooker capable of driving two resonant circuits by means of an inverter with three switching devices while preventing or reducing noise that may be generated during the driving of the resonant circuits, and a driving method of the electronic induction heating cooker.

In one embodiment, an electronic induction heating cooker may include a rectifier configured to rectify an input voltage into a direct current (DC) voltage and output the DC voltage; an inverter configured to generate an alternating current (AC) voltage by switching the DC voltage; a first heater configured to be driven by the AC voltage so as to heat a first cooking container; a second heater configured to be connected in parallel to the first heater, and to be driven by the AC voltage so as to heat a second cooking container; and a switching controller configured to output to the inverter a switching signal for controlling the first and second heaters in accordance with an operation mode input thereto, wherein the operation mode comprises a first operation mode for driving only the first heater, a second operation mode for driving only the second heater, and a third operation mode for driving both the first and second heaters at the same time.

The inverter may be further configured to include first, second and third switches connected in series between a positive power source terminal and a negative power source terminal.

The first heater may include a first resonant capacitor configured to include a plurality of capacitors connected in series between the positive power source terminal and the negative power source terminal; and a first heating coil configured to have a first end connected to a connection node between the first and second switches and a second end connected to a connection node between the plurality of capacitors.

The second heater may include a second resonant capacitor configured to include a plurality of capacitors connected in series between the positive power source terminal and the negative power source terminal; and a second heating coil configured to have a first end connected to a connection node between the second and third switches and a second end connected to a connection node between the plurality of capacitors.

Each of the first, second and third switches may include an anti-parallel diode and an auxiliary resonant capacitor connected in parallel to the anti-parallel diode.

The switching controller may be further configured to, in response to the first operation mode being selected, output a first switching signal for controlling the first and second switches to be alternately open and controlling the third switch to either continue to be closed or be open or closed in synchronization with the second switch.

The switching controller may be further configured to, in response to the second operation mode being selected, output a second switching signal for controlling the second and third switches to be alternately open.

The switching controller may be further configured to, in response to the third operation mode being selected, output a third switching signal for controlling the first and third switches to be alternately open and controlling the second switch to continue to be closed.

The operation mode may also include a fourth operation mode for alternately driving the first and second heaters, wherein the switching controller may be further configured to, in response to the fourth operation mode being selected, alternately output the first and second switching signals at regular intervals of time.

In another embodiment, a driving method of an electronic induction heating cooker, which has first and second heaters, may include receiving a selection of an operation mode; in response to the selected operation mode being a first operation mode, outputting a first switching signal for driving only the first heater; in response to the selected operation mode being a second operation mode, outputting a second switching signal for driving only the second heater; and in response to the selected operation mode being a third operation mode, outputting a third switching signal for driving both the first and second heaters at the same time, wherein the first, second and third switching signals are applied to an inverter including first, second and third switches connected in series.

The outputting the first switching signal, may include outputting a first switching signal for controlling the first and second switches to be alternately open and controlling the third switch to either continue to be closed or be open or closed in synchronization with the second switch.

The outputting the second switching signal, may include outputting a second switching signal for controlling the second and third switches to be alternately open.

The outputting the third switching signal, may include outputting a third switching signal for controlling the first and third switches to be alternately open and controlling the second switch to continue to be closed.

The method may also include, in response to the selected operation mode being a fourth operation mode, outputting a fourth switching signal for alternately driving the first and second heaters, wherein the outputting the fourth switching signal, includes alternately outputting the first and second switching signals at regular intervals of time.

According to embodiments, a plurality of heating coils may be driven using a single inverter with three switching devices, the volume of an induction heating cooker may be reduced by simplifying the circuitry, and the manufacturing cost of an electronic induction heating cooker may be reduced.

According to embodiments, user satisfaction may be improved by driving a plurality of heating coils at the same time using a single inverter with three switching devices.

According to embodiments, no additional switches for driving a plurality of heating coils are required because of the use of a single inverter. Accordingly, the reliability and user satisfaction of such an electronic induction heating cooker may be improved and noise generated by such switches may be prevented.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heating cooker, comprising:

a rectifier configured to rectify an input voltage into a direct current (DC) voltage and output the DC voltage;

an inverter configured to generate an alternating current (AC) voltage from the DC voltage;

a first heater configured to be driven by the AC voltage;

a second heater connected in parallel to the first heater, and configured to be driven by the AC voltage; and a switching controller configured to output a switching signal to the inverter for controlling the first and second heaters in accordance with a selected operation mode, wherein the selected operation mode includes one of a first operation mode for driving only the first heater, a second operation mode for driving only the second heater, or a third operation mode for simultaneously driving both the first and second heaters, wherein the inverter includes first, second, and third switches connected in series between a positive power source terminal and a negative power source terminal, and wherein the first heater includes:

a first resonant capacitor including a first plurality of capacitors connected in series between the positive power source terminal and the negative power source terminal; and a first heating coil having a first end thereof connected to a first connection node between the first and second switches and a second end thereof connected to a first connection node between two of the first plurality of capacitors.

2. The induction heating cooker of claim 1, wherein the second heater includes:

a second resonant capacitor including a second plurality of capacitors connected in series between the positive power source terminal and the negative power source terminal; and a second heating coil having a first end thereof connected to a second connection node between the second and third switches and a second end connected to a second connection node between two of the second plurality of capacitors.

3. The induction heating cooker of claim 2, wherein each of the first, second and third switches includes:

an anti-parallel diode; and an auxiliary resonant capacitor connected in parallel to the anti-parallel diode.

4. An induction heating cooker, comprising:

a rectifier configured to rectify an input voltage into a direct current (DC) voltage and output the DC voltage;

an inverter configured to generate an alternating current (AC) voltage from the DC voltage;

a first heater configured to be driven by the AC voltage;

a second heater connected in parallel to the first heater, and configured to be driven by the AC voltage; and a switching controller configured to output a switching signal to the inverter for controlling the first and second heaters in accordance with a selected operation mode, wherein the selected operation mode includes one of a first operation mode for driving only the first heater, a second operation mode for driving only the second heater, or a third operation mode for simultaneously driving both the first and second heaters, wherein the inverter includes first, second and third switches connected in series between a positive power source terminal and a negative power source terminal, and wherein, in response to selection of the first operation mode, the switching controller is configured to output a first switching signal for controlling the first and second switches to be alternately open and for controlling the third switch to either remain closed or be open or closed in synchronization with the second switch.

5. The induction heating cooker of claim 4, wherein, in response to selection of the second operation mode, the switching controller is configured to output a second switching signal for controlling the second and third switches to be alternately open.

6. The induction heating cooker of claim 5, wherein, in response to selection of the third operation mode, the switching controller is configured to output a third switching signal for controlling the first and third switches to be alternately open and for controlling the second switch to remain closed.

7. The induction heating cooker of claim 5, further including a fourth operation mode for alternately driving the first and second heaters, wherein, in response to selection of the fourth operation mode, the switching controller is configured to alternately output the first and second switching signals at regular intervals of time.

8. A method of driving an induction heating cooker comprising first and second heaters, the method comprising:

receiving a selection of one of a plurality of operation modes;

in response to selection of a first operation mode, outputting a first switching signal for driving only the first heater;

in response to selection of a second operation mode, outputting a second switching signal for driving only the second heater; and in response to selection of a third operation mode, outputting a third switching signal for simultaneously driving both the first and second heaters, wherein the first, second and third switching signals are applied to an inverter including first, second and third switches connected in series, and wherein outputting the first switching signal includes:

controlling the first and second switches to be alternately open; and controlling the third switch to either remain closed or be open or closed in synchronization with the second switch.

9. The method of claim 8, wherein outputting the second switching signal includes outputting a signal for controlling the second and third switches to be alternately open.

10. The method of claim 8, wherein outputting the third switching signal includes outputting a signal for controlling the first and third switches to be alternately open and controlling the second switch to remain closed.

11. The method of claim 8, further including:

in response to selection of a fourth operation mode, outputting a fourth switching signal for alternately driving the first and second heaters, wherein outputting the fourth switching signal includes alternately outputting the first and second switching signals at regular intervals of time.

* * * * *